United States Patent [19]

Cowlin et al.

[11] Patent Number: 4,655,110

[45] Date of Patent: Apr. 7, 1987

[54] METHOD AND APPARATUS FOR CUTTING BLEMISHES FROM ELONGATE ARTICLES

[75] Inventors: Robert M. Cowlin; Simon Cowlin, both of Thorpness, United Kingdom

[73] Assignee: Lockwood Graders (UK) Limited, Danbury, United Kingdom

[21] Appl. No.: 824,966

[22] Filed: Jan. 31, 1986

[30] Foreign Application Priority Data

Jan. 31, 1985 [GB] United Kingdom ..... 8502389

[51] Int. Cl.[4] ..... B26D 5/30

[52] U.S. Cl. ..... 83/27; 83/71; 83/99; 83/104; 83/371; 83/411 R

[58] Field of Search ..... 83/23, 27, 71, 80, 104, 83/98, 99, 364, 371, 410, 411 R

[56] References Cited

U.S. PATENT DOCUMENTS 4,520,702 6/1985 Davis et al. ..... 83/371 X

*Primary Examiner*—James M. Meister

*Attorney, Agent, or Firm*—Cushman, Darby & Cushman

[57] ABSTRACT

A method and apparatus for cutting dark portions such as blemishes from articles such as potato stick. In order to detect the blemishes the articles are conveyed through an inspection station by a conveyor having a plurality of rollers arranged perpendicular to the direction of conveyor. The rollers are rotated thereby rotating the articles as they are conveyed through the inspection station so that each side of the articles may be inspected. The inspection station utilizes a raster scan television camera and output signals therefrom are used to actuate one of a plurality of cutting devices in order to sever from the articles those portions containing blemishes. The severed portions containing blemishes are thereafter separated from the remainder of the articles by either a screen or by air jets.

11 Claims, 3 Drawing Figures

METHOD AND APPARATUS FOR CUTTING BLEMISHES FROM ELONGATE ARTICLES

This invention relates to apparatus for treating and for automatically cutting and sorting elongate articles, in accordance with colour or shade variation on their surface, in particular in accordance with dark or light areas on their surface. It has particular though not exclusive application in the treatment and sorting of various crops, so as to remove black or dark regions, or coloured regions from them.

For example, it the production of potato sticks for use in making french fries (chips), a substantial proportion of sticks as produced from a cut potato will show the presence of dark spots, derived from blemishes or faults in the original potato. To treat potato sticks manually to remove such flawed sticks is costly and time consuming. It is therefore desirable to be able to use automatic machinery capable of cutting out dark regions from a potato stick, whilst removing a minimum amount of the good potato.

A similar application arises in the treatment of elongate crops such as salsify, and asparagus, in which it is desirable to cut out either dark or defective portions, or else the light and woody portions of the stems.

Previous proposals have been made for automating the process of removing flaws from potato sticks.

For example, Published European Patent Specification No. 97400 discloses a machine for removing flaws from potato sticks in which the sticks are passed through an inspection region with their axes aligned along their direction of movement, and are scanned by a camera. Logic circuitry is used to decide from the camera output on the occurrence of flaws, and to relate their occurrence to a position on the moving conveyor. The sticks are then subsequently passed through a cutting region, in which the dark regions are severed.

Because the sticks are aligned along the direction of movement, it is important that they are accurately orientated, so that when they reach the cutting station, the cutting knife which is actuated cuts only the selected defect from the stick, and does not remove non-defective products from adjacent sticks. In the commercial embodiment of the device in accordance with EP No. 97400, this is achieved by providing a plurality of narrow belt conveyors, operating in channels so sized as to accommodate the sticks in singulated form. This arrangement has the consequence that it is very difficult to ensure that the articles or sticks to be cut lie properly on the conveyors in the channels, and it is generally necessary to provide a vibrator to supply the sticks onto the conveyors, and subsequently numerous brushes and the like on top of the channels, to sweep away sticks which are not properly aligned in the channels. These additional items, and in particular the vibrator, add substantially to the overall cost of the apparatus.

Additionally, when belts are used to deliver the articles to the cutting station, the possibility exists that the belts will slip on the rollers used to drive them, and also that the articles themselves will slide along the belts. This leads to lack of accurate registration with the cutting knives, and cuts being made in the wrong position.

Furthermore, because the sticks are aligned along the direction of movement, any small error in the calculation of the delay period for activation of the cutting knives in the cutting region means that the potato stick is severed at an incorrect position, and this leads to the incorporation in the product of blemished potato material, and to the wastage of the unblemished material.

This places a restriction on the speed at which the device of EP No. 97400 is able to operate.

An additional substantial problem which occurs when the articles are delivered to the cutting region with belts is that the gap between the extended position of the cutting knives, and the belts must be very accurately set, so as to avoid, on the one hand, a product which is insufficiently cut, or on the other, the knives extending so far that they cut and damage the belts themselves, with consequent loss in production. A further disadvantage when the articles are presented longitudinally, as in EP No. 97400, is that, because of the need for accuracy in orientation, different sizes of channel must be provided for each different size of article to be cut. In the production of potato sticks for french fried potatoes for example, it is commonly required to produce sticks having a thickness which may be as small as 3 mm, or as large as 13 mm or more. Utilising the apparatus of EP No. 97400, it is necessary for the conveyor to be removed, and replaced by an alternative conveyor, with different size channels, in order to accommodate the size variation.

Lastly, the device of EP No. 97400 utilises a line-scan camera, that is to say a camera which scans very rapidly along a single line, and detects areas of dark and light along that line. The system can therefore take decisions as to whether or not an article incorporates a flaw based on a view from only one side of the articles. It is difficult or impossible using this prior art process to assess reliably the occurrence of defects on the underneath or side areas of articles on the conveyor.

According to the present invention, there is provided apparatus for treating elongate articles, which articles include regions having a shade which differs substantially from that of the remainder of the articles, which apparatus comprises a conveyor, comprising a plurality of rollers for supporting the articles, and for conveying the articles through an inspection region, the rollers being aligned with their axes substantially perpendicular to the direction of movement of the articles through the region, means for rotating the rollers and thereby rotating the articles as they are conveyed through the region, whereby the combined effect of the movement and rotation of articles in the region is to tend to render substantially stationary an upper point on each article for at least a period of time during its passage through the inspection region, a raster scan television camera mounted so as to view the article within the inspection region, means for deriving from the television camera an output indicative of the presence and location of the aforesaid regions on the articles, means for actuating at least one of a plurality of cutting devices in accordance with the said output obtained, to sever from the articles, as relatively small pieces the said regions, and means for separating the relatively small pieces from the remainder of the particles, to thereby remove from the articles the said regions with a shade difference.

The term "shade difference" as used herein is intended to encompass not only difference in luminance, but also differences in hue or colour saturation, or any other quality which enables the relevant areas to be distinguished.

European Patent Specification No. 58028 discloses a method and apparatus for the detection and location of black spots in an image, and in particular, a method of detecting a black spot by detecting edge transitions in a scanned image. The method and apparatus for deriving an output indicative of shade difference utilized in the present invention is preferably of the kind disclosed in European Patent Specification No. 58028, ie. the apparatus may include means for detecting the presence of bounded regions within the regions scanned by the camera.

Alternatively, each picture point may be graded according to a grey scale, and the decision as to whether or not a picture point represents a blemish taken according to the level of the signal from the particular picture point on the grey scale. In either event, the output signal from the television camera is connected to appropriate logic circuitry, to enable a decision to be taken as to the edge of a blemish or spot. A further possibility is that picture points may be graded according to their colour characteristics, such as hue, using for example, the technique disclosed in U.K. Patent Application No. 8505781 or any other colour detection technique of a conventional form.

However it is derived, the information about the presence of a blemish or other area which it is desired to remove is then related by appropriate logic circuitry to the gap between a particular pair of rollers, and the gap, and the position along the rollers is "tagged" by the computer, so that a cutting mechanism may be operated downstream of the inspection region.

The conveyor or "roller table" may also be as disclosed in European Patent Application No. 58028. The conveyor consists of a plurality of rollers, spaced at an appropriate distance apart to support and rotate the elongate articles for which the apparatus is intended to be used. In is to be noted, however, that the arrangement in accordance with the invention, using rotating rollers, enables a very wide range of article sizes to be accommodated, such that in general it is not necessary to change the size of rollers being used, for each size of article which it is desired to process.

During movement of the rollers through the inspection region, they rotate in a direction such as to tend to render substantially stationary an upper point on the articles, as they move through the region. By this method, each side of the article can be inspected for shade differences, and furthermore, the tendency of the movement of the articles to smear the image recorded by the camera is minimised.

It is important that the camera utilised is a raster scan television camera, rather than a line scan camera, so that the articles can be followed through the inspection region as they rotate, and thereby each side of the article can be examined.

In a particular preferred embodiment, the logic circuitry may be programmed and arranged so as to ignore, or at least give less weight to signals received from parts of the inspection region correspondig to the rollers themselves, rather than the gaps between them. Obviously, the position of the regions which are ignored will move, as the rollers move through the inspection region, and a computer is preferably arranged so as to follow the movement of the gaps beteen the rollers, and to discard signals originating from the rollers themselves. This technique enables substantial economies in computing time to be achieved.

Particularly when the "grey scale" method is utilized a dark spot may be provided within the optical system, for example on a surface of a lens of the camera, or a screen associated with the optical system, to provide a calibration of the grey scale measurement. The device may be programmed so as to effect such calibration automatically, on each scan of the image.

The cutting devices used in the present invention are preferably arranged so as to be perpendicular to the axes of the rollers, and to operate by a chopping action, into the gap between the two rollers in which a blemished article lies. Thus, a bank of pneumatically operated knives is preferably provided at the end of the roller table. Because the elongate articles are arranged with their long axis transverse to their direction of movement, the position on the article at which cutting takes place is quite independent of any speed variation in the conveyor and error in the timing calculation.

In a particularly preferred embodiment, the rollers are provided with slots or recesses, transverse to their axis of rotation (i.e. parallel with the direction of motion of the articles). The cutting devices in the cutting region can then be arranged to operate into the slots or recesses, such that each article is thoroughly severed. Because of the slots in the rollers, the need for accurate alignment of the end position of the cutting devices is eliminated, and the risk of damage to the rollers is minimized.

The knives are so positioned as to be capable of chopping pieces from the articles which are substantially shorter than the length of the articles themselves, and may, for example, be positioned at separations of from 5 to 20 mm, preferably approximatey 10 mm .

The computer logic is preferably arranged so as to activate not only the cutting member appropriate to actually sever the blemish from a blemished article, but also any cutting members which actully fall within the blemished area, so that the blemishes which are severed are substantially shorter in length than the remainder of the article.

In a further particularly preferred embodiment, means are provided, for example a plurality of air jets and/or pneumatically operable fingers for routing the severed portions differently from the remainder of the articles.

A preferred embodiment of the inventon will now be described with reference to the accompanying drawings, in which.

Figure 1:
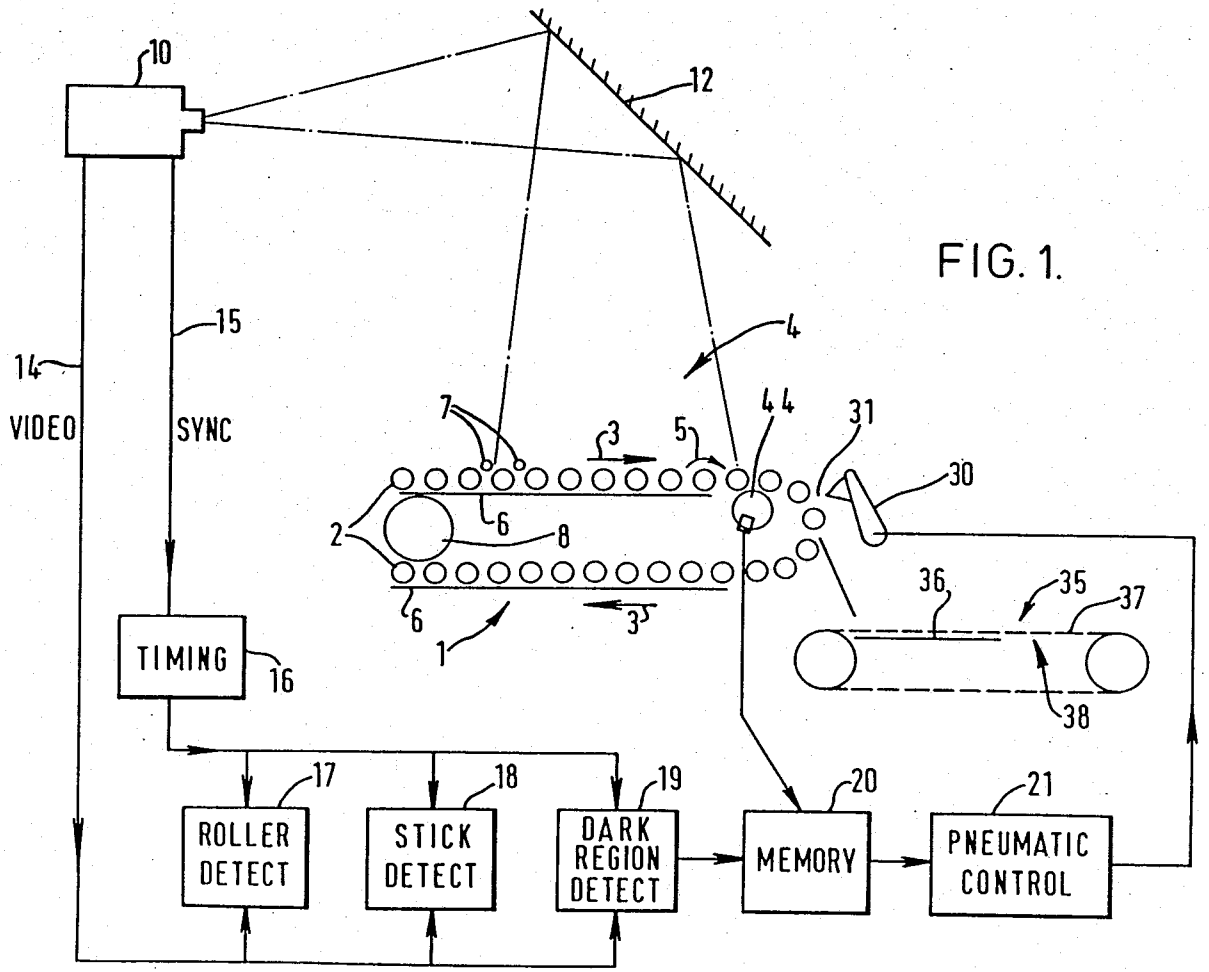
FIG. 1 is a schematic side view of apparatus according to the invention.

The apparatus illustrated in FIG. 1 comprises a roller table shown schematically at 1, comprising a plurality of rotatable rollers 2, driven for movement in the direction of arrows 3, through a inspection region 4.

The rollers 2 are supported by support tracks 6, and are driven so as each to rotate in the direction of arrow 5, during their movement through the inspection region 4. Means (not shown) for example a vibrator or the like are provided for introducing potato sticks 7 onto the roller table 1, so that the potato sticks 7 are supported by the rollers 2, with their axes parallel to the axes of the rollers, (that is, perpendicular to the direction of movement of the potato sticks through the inspection region 4). The speed of rotation of the rollers 2 is matched to the speed of movement through the inspection region 4, so that each upper point on each of the potato sticks 7 remains substantially stationary, at least for a short period during the movement of the sticks 7 through the inspection region.

It will be appreciated that, because the articles are driven from their periphery, the speed of movement and rotation of the rollers does not have to be varied for different sizes of article 7. This is a significant advantage over devices used in the prior art in which articles are orientated parallel to the direction of motion. In such prior art devices, the conveyor must be changed to accomodate articles of varying sizes. Furthermore, the apparatus according to the invention can accomodate articles of irregular cross section, for example so called "crinkle cut" potato sticks.

An intermediate roller 8 is provided between the upper and lower runs of the roller table 1. The intermediate roller 8 is driven by the lower run of roller table 1, and serves to reverse temporarily the direction of rotation of the rollers 2, in a position before that at which they enter the inspection region 4. This tends to prevent any of the articles 7 from lodging on the upper surface of the rollers 2, parallel to the direction of movement, without falling into the gap between rollers. If this should happen, the article can be propelled at high speed through the inspection region 4, giving a false reading.

The inspection region is viewed by a television camera 10, operating on a raster scan principle. The camera 10 scans the inspection region 4 through a plane mirror 12, mounted above the conveyor 1. The camera 10 provides a video output signal on line 14, and a scan synchronising signal on a line 15, both of which are processed by a computer comprising timing unit 16, roller detect unit 17, stick detect unit 18, dark region or blemish detect function 19, memory 20, and pneumatic control means 21.

The camera 10 is arranged to provided a 625 line scan of the inspection region 4, the direction of scan being along the direction of motion of the roller table 1. The direction of scan could alternatively be perpendicular to the direction of motion of the roller table 1, but the former arrangement enables the position of a potato stick across the width of the roller table to be determined as a proportion of the frame scan period, which is much larger than a line scan period, and therefore easier to measure.

Each roller may be provided with timing indicia as disclosed in European Patent Application No. 58028.

The method of detecting a flaw in a potato stick may preferably be as disclosed in European Patent Application No. 58028, in which movement of the rollers is detected by a roller detect unit 17, the presence of a potato stick by stick detect unit 18, and the presence of a darker region associated with a potato stick by dark region detect unit 19.

Alternatively, a decision as to whether or not an area of image relates to a defect may be made simply by grading the image according to a grey scale, and designating certain shades of grey as relating to defects which it is desired to excise.

Whichever method is employed, the location of the particular pair of rollers between which lies a potato stick having a dark spot is stored in memory unit 20, and related by the computer to the speed of movement of the conveyor 1 based on data from shaft encoder 44.

A bank of pneumatically operated knives 30 is arranged perpendicular to the roller bed such that, on rotation of a pneumatic actuator (not shown) knife 30 caused to approach the rollers 2 at a cutting location 31, between two adjacent rollers to sever the blemished portion of a stick 7. The knives 30 are spaced approximately 15 mm apart across the width of the roller bed, so that by actuation of adjacent knives 30, the potato sticks can be cut into lengths not exceeding 15 mm.

On arrival at the cutting location 31 of a stick 7 in which a defect has been detected by the camera 10 and unit 19, the cutting member 30 appropriate to sever the defect from the rest of the potato stick is actuated. In addition, adjacent cutting members 30 are actuated so as to comminute the defect region to pieces of a size no greater than 10 mm in length.

In the embodiment shown in FIG. 1 the remaining cut and uncut sticks then fall together with the comminuted defects from the region 31 on to a separating device, shown generally as 35. The separating device 35 comprises a flat receiving bed 36, on which lies a moving screen 37. The bed 36 may, if desired, be is caused to vibrate, to cause the sticks 7 to lie flat. The sticks 7 are then carried by the screen 37 into a region 38, where the screen 37 is not supported by platform 36. In this region, the sticks 7 are carried by the screen 37, but the severed portions fall through the holes in the screen to waste.

Figure 2:
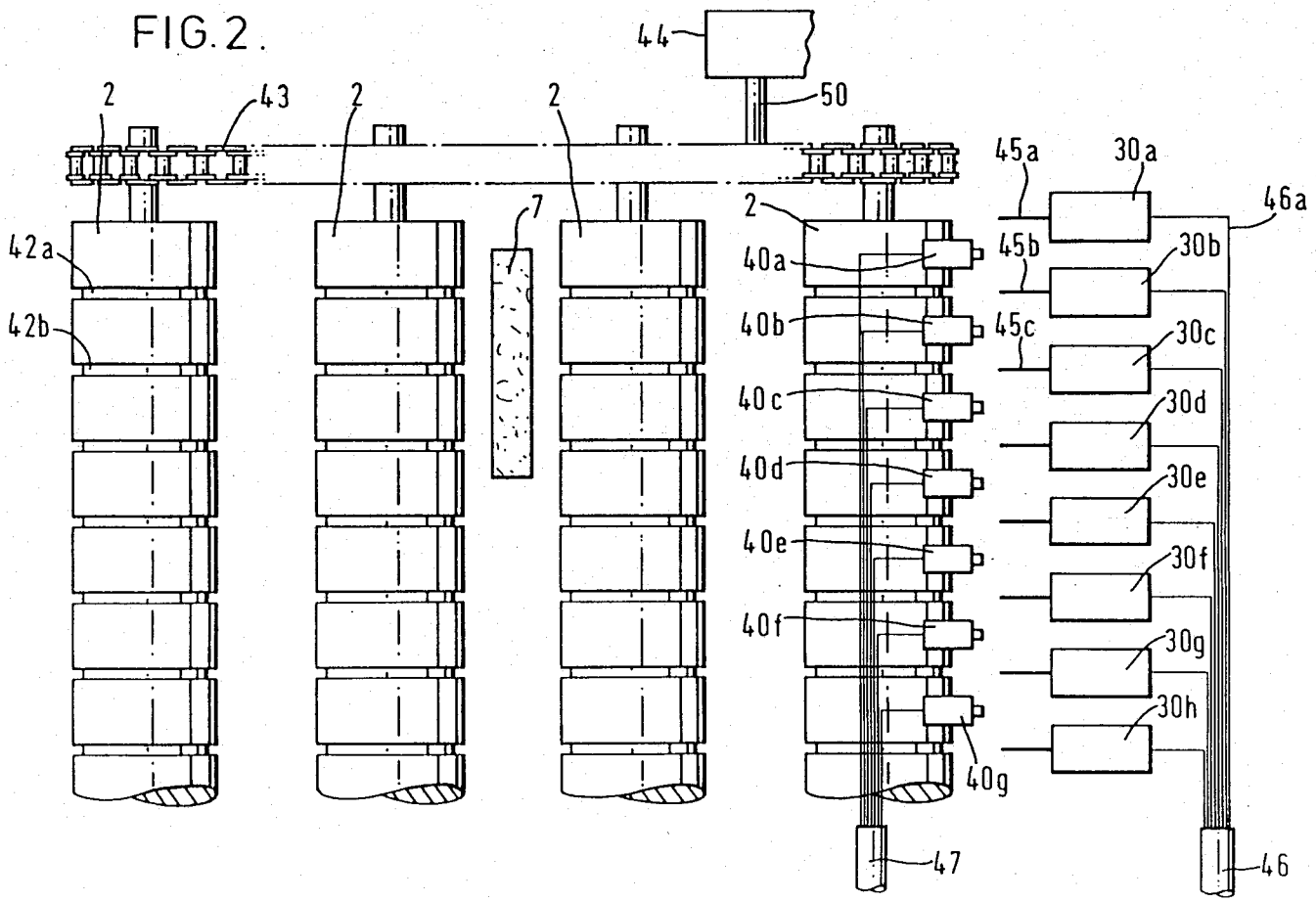
FIG. 2 is a schematic plan view of part of an alternative embodiment.
Figure 3:
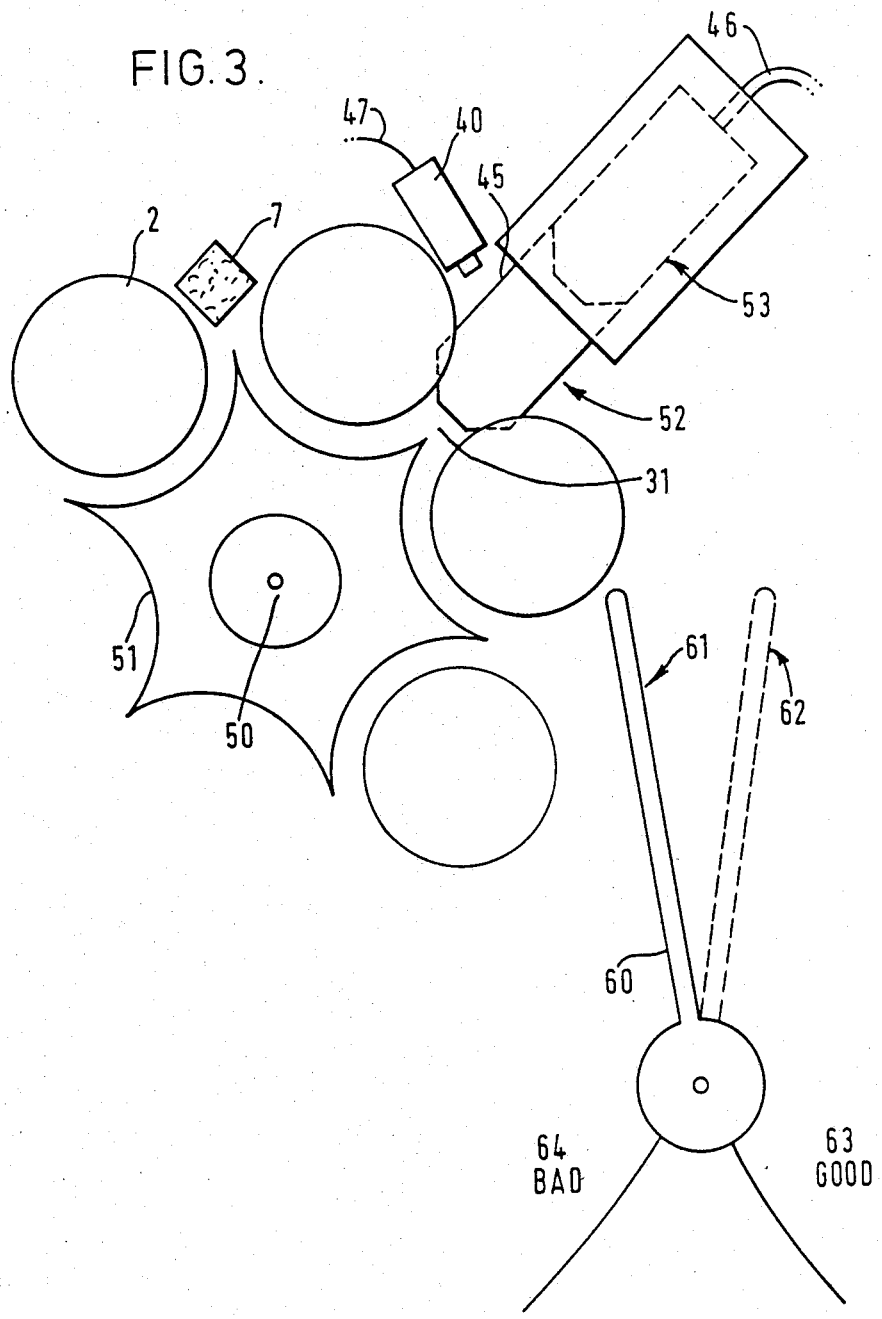
FIG. 3 is a schematic end view of the embodiment illustrated in FIG. 2.

FIG. 2 is a plan view of preferred embodiment of a part of apparatus similar to that illustrated in FIG. 1, but utilising a different type of pneumatic knife, and incorporating air jets to remove the defective parts of the potatoes. In FIG. 2, like reference numbers refer to like parts as in FIG. 1, except that the individual pneumatically operated knives are designated **30*a*, 30*b*, 30*c* etc. FIG. 3 is a schematic end view, on an enlarged scale, of the embodiment of FIG. 2**.

In the embodiment of FIG. 2, the rollers 2 are each provided with a plurality of grooves **42*a*, 42*b*, etc, which are aligned with the cutting blades 45*a*, 46*b* etc. of pneumatic knives 30*a*, 30*b* etc. Also illustrated in FIG. 2 are chains 43, by means of which rollers 2 are driven along the roller table, and shaft a encoder 44, which is mounted on shaft 50. Shaft 50 also carries a sprocket 51, which serves to guide rollers 6**, and to keep the appropriate tension in the roller bed.

Only an end portion of the roller table is shown, for clarity, and a commercial embodiment of a machine in accordance with the invention may be provided with as many as a hundred adjacent knives **30*a*, 30*b* etc, and corresponding grooves 42*a*, 42*b*. Pneumatic knives 30*a*, 30*b* etc. are connected to a computer-controlled pneumatic control 21, as illustrated in FIG. 1**.

Each of the pneumatically operated knives **30*a*, 30*b* etc. comprises a single-acting pneumatic cylinder, in which the air pressure is caused to operate directly on a blade 45, wich co-operates with groove 42*a* etc. The blades 45*a*, 45*b* etc. are caused to return into the respective cylinder by means of a return spring (not shown). FIG. 3 illustrates knife 45 in its retracted position 53, and its extended position 52**.

The blade 45 is caused to retract fully in to the housing of knife 30, in its retracted position 53, so as to ensure that any severed material is wiped from its surface, during retraction.

Between the blades **45*a*, 45*b* etc. illustrated in FIG. 2, there are provided nozzles 40*a*, 40*b* etc. for compressed air, directed onto the cutting station 31. Nozzles 40*a*, 40*b* etc. are connected via pneumatic conduits 47 to pneumatic control device 21, which operates under computer control so as to provide a blast of air through nozzles 40, as the blades 45 retract, after the cutting stroke. It is important that the pneumatic conduits 47 are each of similar length, so that timing of the jets from nozzles 40 may be synchronised accurately with the movement of the conveyor 1. Similarly pneumatic conduits 46** should be of similar length.

In one embodiment, nozzle 40 are arranged to operate whenever a potato stick is detected, which is cut by blades 45. However, in a particularly preferred embodiment, only those nozzles **40*b*, 40*c***, operate which are located in a position corresponding to a detected blemish. Thus, the blemished portions of the potato sticks can be deflected, and routed different from the non-blemished portions.

Because the rollers 2 rotate as they pass through the inspection region 4, the means utilized to deliver the articles (e.g. the potato sticks) onto the conveyor 1 can be far less complex than utilised in the prior art. Thus, although a vibrator can be used if desired, this will in general not be necessary.

The presence of the grooves 42 in rollers 2 minimises the danger of damage to the rollers by the blades 45, and minimises also the need for accurate setting up of the knives 45.

Furthermore, because once a particular stick has located itself in a particular gap between two rollers 2, it is unlikely to move from that gap, problems of sliding of sticks along belts, or slippage of belts on rollers do not arise.

When the articles with which the apparatus is to be used are square in shape, as, for example, are potato sticks, a longitudinal groove may be provided on rollers 2, in addition to the lateral grooves 42, to improve traction, between rollers 2 and the articles 7.

It will be appreciated that although the invention has been illustrated with reference to its use in the removal of blemishes from potato sticks, it is equally applicable for use on any elongate articles, having distinct regions which have a shade differing substantially from that of the remainder of the articles. The articles may, for example, be generally dark in shade, and have occasional white spots, which it is desired to separate, rather than vice versa. Furthermore, the portions which are severed need not be defects, but could, for example, be the part of the articles which it is desired to retain. Various other modifications of the invention will be readily apparent to one skilled in the art from the foregoing description.

We claim:

1. Apparatus for treating elongate articles, which articles include regions having a shade which differs substantially from that of the remainder of the articles, which apparatus comprises a conveyor, comprising a plurality of rollers for supporting the articles, and for conveying the articles through an inspection region, the rollers being aligned with their axes substantially perpendicular to the direction of movement of the articles through the region, means for rotating the rollers and thereby rotating the articles as they are conveyed through the region, a raster scan television camera mounted so as to view the article within the inspection region, means for deriving from the television camera on output indicative of the presence and location of the aforesaid regions on the articles, means for actuating at least one of a plurality of cutting devices in accordance with the said output obtained, to sever from the articles as relatively small pieces the said regions, and means for separating the relatively small pieces from the remainder of the articles, to thereby remove from the articles the said regions with a shade difference.

2. Apparatus as claimed in claim 1, wherein the rollers are each provided with a plurality of transverse recesses to accommodate the said cutting devices.

3. Apparatus as claimed in claim 1, including means for selectively routing pieces derived from the said regions differently from pieces derived from the remainder of the articles.

4. Apparatus as claimed in claim 3, wherein the said selective routing means comprises a plurality of pneumatic fingers or of pneumatic jets.

5. Apparatus as claimed in claim 1, wherein the rollers are provided with a plurality of elongate grooves, to improve traction with the articles.

6. Apparatus as claimed in claim 1, wherein the arrangement is such that the combined effect of the movement and rotation of articles in the region is to tend to render substantially stationary an upper point on each article for at least a period of time during its passage through the inspection region.

7. Apparatus as claimed in claim 1, wherein the means for deriving the output signal includes means for detecting the presence of bounded regions within the regions scanned by the camera.

8. Apparatus as claimed in claim 1, wherein the means for deriving the output signal includes means for classifying different areas of the inspection region in accordance with a grey scale, and for distinguishing between the said regions on the remainder of the articles in accordance with the said grey scale classification.

9. Apparatus as claimed in claim 1, including means for varying the weighting of signals derived from different parts of the inspection region, according to whether or not the said part of the image corresponds to a roller, or a gap between rollers.

10. Apparatus as claimed in claim 1, wherein the said plurality of cutting devices are spaced from each other by a distance of from 5 mm to 20 mm.

11. A method for treating elongate articles, which method comprises causing the articles to pass through an inspection region with their axes transverse to their direction of motion, rotating the articles in the inspection region, whereby the combined effect of the movement and rotation of the articles in the region is to tend to render substantially stationary an upper point on each article for at least a period of time during its passage through the inspection region, scanning the articles in the inspection region using a raster scan television camera, deriving from the television camera an output indicative of the presence and location on the articles of regions having a shade which differs substantially from that of the remainder of the articles, actuating cutting devices in accordance with the said output obtained, to sever from the articles, as relatively small pieces, the said regions, and means for separating the relatively small pieces from the remainder of the articles, to thereby remove from the articles the said regions with a shade difference.

* * * * *